US009822325B2

(12) United States Patent
Favero et al.

(10) Patent No.: US 9,822,325 B2
(45) Date of Patent: Nov. 21, 2017

(54) PROCESS FOR FRICTION REDUCTION DURING ETHANOL TRANSPORT

(71) Applicant: S.P.C.M. SA, Andrezieux Boutheon (FR)

(72) Inventors: Cédrick Favero, Saint Romain le Puy (FR); Olivier Braun, Saint Just Saint Rambert (FR); Pierrick Cheucle, Saint Romain le Puy (FR); Bernard Quillien, Sorbiers (FR)

(73) Assignee: S.P.C.M. SA, Andrezieux Boutheon (FR)

( * ) Notice: Subject to any disclaimer, the term of this patent is extended or adjusted under 35 U.S.C. 154(b) by 135 days.

(21) Appl. No.: 14/713,532

(22) Filed: May 15, 2015

(65) Prior Publication Data

US 2015/0337232 A1 Nov. 26, 2015

(30) Foreign Application Priority Data

May 21, 2014 (FR) ..... 14 54595

(51) Int. Cl.

| | |
|---|---|
| ***C10M 173/00*** | (2006.01) |
| ***C10M 173/02*** | (2006.01) |
| ***C10M 151/02*** | (2006.01) |
| ***C10L 1/02*** | (2006.01) |
| ***C10L 1/196*** | (2006.01) |
| ***C10L 1/236*** | (2006.01) |

(52) U.S. Cl.

CPC ..... *C10M 151/02* (2013.01); *C10L 1/023* (2013.01); *C10L 1/1963* (2013.01); *C10L 1/2364* (2013.01); *C10L 2200/0469* (2013.01); *C10L 2230/14* (2013.01); *C10L 2250/04* (2013.01)

(58) Field of Classification Search

CPC ..... C10M 2201/02; C10M 2215/04; C10M 2215/28

USPC ..... 508/404, 513, 551

See application file for complete search history.

(56) References Cited

U.S. PATENT DOCUMENTS

| | | | | |
|---|---|---|---|---|
| 4,522,733 | A * | 6/1985 | Jonnes | C10M 173/02 508/507 |
| 4,637,418 | A | 1/1987 | Karl | |
| 2005/0049327 | A1 | 3/2005 | Jovancicevic et al. | |
| 2010/0029843 | A1 | 2/2010 | Milligan | |
| 2011/0180759 | A1* | 7/2011 | Korosec | C10L 1/14 252/392 |

FOREIGN PATENT DOCUMENTS

| | | | |
|---|---|---|---|
| BR | PI0900355 | A2 | 8/2011 |
| EP | 2383327 | A1 | 11/2011 |
| WO | 2013/123288 | A1 | 8/2013 |
| WO | 2013/160228 | A1 | 10/2013 |
| WO | 2013/171319 | A1 | 11/2013 |

OTHER PUBLICATIONS

International Search Report for FR1454595 dated Jan. 5, 2015.

* cited by examiner

*Primary Examiner* — Vishal Vasisth

(74) *Attorney, Agent, or Firm* — Heslin Rothenberg Farley & Mesiti P.C.

(57) ABSTRACT

This invention involves a process for reducing friction in ethanol during its transport through pipelines. This process involves combining ethanol with a polymer-based composition, characterized in that the polymer is obtained from at least 50 mol % of at least one monomer selected from the group comprising N-substituted acrylamides, N-substituted methacrylamides, N,N-substituted acrylamides, N,N-substituted methacrylamides, substituted acrylates and substituted methacrylates.

20 Claims, No Drawings

PROCESS FOR FRICTION REDUCTION DURING ETHANOL TRANSPORT

CROSS REFERENCE TO RELATED APPLICATIONS

This application is a U.S. non-provisional filing, which claims priority to French Application No. 1454595, filed on May 21, 2014, the entire contents of which are hereby incorporated herein by reference.

This invention concerns the field of ethanol transport. The invention involves the use of a specific polymer as a friction reducer for the transport of ethanol.

The transport of ethanol, and especially bioethanol, is a matter of importance in a context of energy transition where fossil fuels are progressively being replaced by alternative technologies. Ethanol (bioethanol) produced from biomass, is highly developed and we are faced with the challenge of transporting it efficiently over long distances.

In 1949 (Proceedings of the International Congress on Rheology, North-Holland), Tom discovered that adding a small quantity of polymers to a turbulent fluid improves its transportation in terms of reducing the friction.

Water-soluble polymers with a high molecular weight are known to play the role of a friction reducer in aqueous solutions. Stretching the polymer chains in the solution helps to delay the turbulent regime when transporting the fluid at a high speed. It results in a reduction in energy that is required for transporting the aqueous solution.

Transporting other fluids at a high speed, with the exception of water, is also subject to such friction issues. However, the problem arises when the polymers developed for transporting aqueous solutions cannot be used owing to their poor solubility in these fluids.

When we say other fluids, we mean organic solvents, oils or biofuels.

The state-of-the-art biofuels dealing with the development of specific polymers for biodiesels (fatty acid ester mixtures) help in reducing their viscosity, especially at low temperatures in order to improve their transportation by pipeline. We can quote specific documents like WO2013/160228 (Evonik Oil Additives), WO2013/123288 (Baker Hughes), WO2013/171319 (Dupont) and EP2383327 (NOF). The polymers described are mainly hydrophobic polymers that belong to the categories of poly(alkyl(meth) acrylates), poly(alkyl meth)acrylamides), polyesters and polyolefins.

Amongst biofuels, we can mention bioethanol: it does not present any problems in terms of viscosity during transportation but is subject to friction. The polymers used conventionally for friction reduction during transport of aqueous solutions (derived from polyacrylamide) cannot be used due to lack of solubility in bioethanol. On the other hand, the document BR PI 0900355 (State University of Campinas) suggests that polymers of the polyethylene glycol type (PEG) are efficient in friction reduction during transport of bioethanol.

A polymer will be all the more efficient in reducing the phenomena of friction since its molecular weight is important. However PEG polymers are not known to have very high molecular weights owing to their synthesis processes.

Polymers with the highest weights are polyacrylamides derivatives but the current products are not soluble in ethanol. As a matter of fact, ethanol is commonly used as a counter-solvent for precipitating polyacrylamides.

The preparation of a polymer capable of reducing friction during ethanol transport requires synthesising a polymer of a very high molecular weight, soluble in ethanol.

A solution for the problem arising from the invention is to develop a polymer that will facilitate friction reduction and thus improve the transport of ethanol.

To her complete surprise, the Applicant discovered that using polymers obtained from N-substituted (meth)acrylamide monomers or N,N-substituted monomers and/or substituted (meth)acrylate monomers helps us to solve this problem.

As well known in the art, the term "(meth)acrylate" refers to either one of methacrylate and acrylate. The term "(meth) acrylamide" refers to either one of methacrylamide and acrylamide.

To be more specific, the purpose of this invention is a process for reducing friction in ethanol during its transport through pipelines that involves combining ethanol with a polymer-based composition, characterised in that the polymer is obtained from at least one monomer selected from the group comprising N-substituted acrylamides, N-substituted methacrylamides, N,N-substituted acrylamides, N,N-substituted methacrylamides, substituted acrylates and substituted methacrylates.

The polymer is advantageously combined with ethanol during transport. In other words, it is advantageously introduced in the pipelines carrying ethanol.

Ethanol can be combined with polymer or a polymer-based composition by means of introduction or injection of the polymer or the said polymer-based composition in the pipeline thus facilitating the transport of a fluid (ethanol).

According to a particular embodiment, polymer can be combined with ethanol before ethanol is introduced in the transport pipeline. This can be done in a storage tank, for example.

Ethanol and the fluids for which transport was improved in this invention, are referred to as ethanol, particularly bioethanol. This also applies to fluids made essentially of ethanol, all the said fluids containing at least 50%, preferably at least 80% of the ethanol weight.

Ethanol is more advantageous than bioethanol. This is preferably made from biomass.

According to a first aspect of the invention, the polymer used in ethanol transport is obtained from at least 50 mol % of at least one monomer selected from the group with N-substituted (meth)acrylamide monomers or N,N-substituted monomers, and substituted (meth)acrylate monomers.

The Applicant discovered that using N-substituted (meth) acrylamide monomers or N,N-substituted monomers and/or substituted (meth)acrylate monomers, help in not only obtaining a high concentration of polymers soluble in both water as well as ethanol, but also obtaining polymers that result in a friction reduction during transport of fluids with an ethanol base. These monomers are advantageously non-ionic.

As previously mentioned, polymers with high molecular weights are particularly efficient. The polymer used in the friction reduction process covered by the invention has a molecular weight preferably between 0.5 and 25 million g/mol, preferably higher than 2 million g/mol, and even preferably higher than 5 million g/mol.

According to an advantageous embodiment, the polymer used in the friction reduction process covered by this invention, comprises at least 80 mol % of the N-substituted (meth)acrylamide monomers or N,N-substituted monomers and/or preferably at least 90 mol % of the substituted (meth)acrylate monomers.

The polymer can particularly be a homopolymer of N-substituted (meth)acrylamide monomers or N,N-substituted monomers or substituted (meth)acrylate monomers.

According to another advantageous embodiment, the N-substituted (meth)acrylamide monomers or N,N-substituted monomers are preferably chosen from N-ethylacrylamide, N-isopropylacrylamide, N-tert-butylacrylamide, diacetone acrylamide, N-hydroxyethyl acrylamide, N-hydroxymethyl acrylamide, N-alkyl acrylamide (alkyl: C3 to C22), N-[Tris(hydroxymethyl)methyl]acrylamide, N-acryloylmorpholine, N,N-dimethylacrylamide, N,N-diethylacrylamide, N,N-dialkylacrylamide (alkyl: C3 to C22).

According to another advantageous embodiment, the substituted (meth)acrylate monomers are preferably chosen from methyl (meth)acrylate, ethyl (meth)acrylate, propyl (meth)acrylate, butyl (meth)acrylate, alkyl (meth)acrylate (C5 to C22), isobornyl (meth)acrylate and 2-ethylhexyl (meth)acrylate, hydroxyethyl (meth)acrylate and hydroxypropyl (meth)acrylate, furfuryl (meth)acrylate and tetrahydrofurfuryl (meth)acrylate, glyceryl (meth)acrylate, glycidyl (meth)acrylate.

In a preferred embodiment of the invention, the carbon chain substituting a part of the monomers mentioned above, enables the polymer to have good solubility in water as well as alcohol. Therefore, the substituted chains of N-substituted (meth)acrylamide monomers or N,N-substituted monomers and/or substituted (meth)acrylate monomers preferably contain less than 30 carbon atoms, preferably less than 10 carbon atoms, and even preferably less than 5 carbon atoms.

Introducing the charges into the polymer structure (i.e. polyelectrolyte) is known to be extremely unfavourable to the solubility of the polymer in ethanol (that is usually a precipitation solvent for the polymer). However, due to the formation of electrostatic repulsions, the polyelectrolyte chains are highly stretched and this adds to the efficiency of the polymer.

The Applicant has thus surprisingly discovered that it was possible to incorporate a certain percentage of charges into the polymer used in the process covered by the invention, without affecting the solubility of the polymer.

In a particular embodiment, the polymer friction reducer according to the invention can additionally include at least one ionic monomer in a quantity less than 40 mol %, preferably less than 20 mol %, even preferably less than 10 mol %.

The ionic monomer is preferably an anionic monomer. This anionic monomer is preferably chosen from acrylic acid, methacrylic acid, itaconic acid, maleic acid, 2-acrylamido-2-methylpropane sulfonic acid (ATBS), vinylsulphonic acid, vinylphosphonic acid, the said anionic monomer being salified either partially or completely, and 3-sulfopropyl methacrylate salts.

According to another embodiment, the ionic monomer can be a cationic monomer. This cationic monomer is preferably chosen from diallyl dimethyl ammonium chloride (DADMAC), dialkylaminoethyl acrylate (ADAME) and dialkylaminoethyl methacrylate (MADAME), dialkylamino propyl acrylamide, dialkylamino propyl methacrylamide as well as their acidified or quaternary salts.

In a preferred embodiment, the polymer used in the process covered by the invention is a N-substituted (meth) acrylamide homopolymer or N,N-substituted homopolymer, a substituted (meth)acrylate homopolymer, a substituted (meth)acrylate copolymer and acrylic acid copolymer, or a N,N-di(m)ethylacrylamide copolymer and 2-acrylamido-2-methylpropane sulfonic acid copolymer (ATBS).

According to a particular embodiment, the polymer is a polymer selected from the group comprising N,N-dimethylacrylamide homopolymer, N,N-diethylacrylamide homopolymer, N,N-dimethylacrylamide copolymer and acrylic acid copolymer, N,N-diethylacrylamide copolymer and acrylic acid copolymer, N,N-dimethylacrylamide copolymer and 2-acrylamido-2-methylpropane sulfonic acid copolymer and N,N-diethylacrylamide copolymer and 2-acrylamido-2-methylpropane sulfonic acid copolymer.

On the other hand, the polymer used in the friction reduction process according to the invention can additionally include at least one non-ionic monomer like the acrylamide.

Generally, the polymer used in this invention does not require developing a particular polymerisation process. In fact, it may be obtained by any polymerisation techniques well known to those skilled in the art, such as by solution polymerisation, suspension polymerisation, gel or mass polymerisation, precipitation polymerisation, emulsion polymerisation (aqueous or reverse) whether or not it is followed by a spray drying step, micellar polymerisation whether or not it is followed by a precipitation step, post-hydrolysis or co-hydrolyse polymerisation, polymerisation called "template", free radical polymerisation or even controlled radical polymerisation.

The polymer can be in a liquid or solid form during its preparation which includes a drying stage such as spray drying, drum-drying or even microwave drying.

The polymer is preferably obtained by a gel synthesis process that enables obtaining polymers with very high molecular weights in an economical and environmentally friendly manner (since it is solvent-free). The gel synthesis process involves polymerising monomers in an aqueous solution in order to obtain a gel which is then dried and ground into a powder.

As previously mentioned, the process covered by the invention includes a stage where the ethanol to be transported is combined with at least one friction reducing polymer, obtained from N-substituted (meth)acrylamide monomers or N,N-substituted monomers and/or substituted (meth)acrylate monomers.

Generally, the process according to the invention is particularly interesting when significant volumes of ethanol are transported over long distances. Especially, when the process according to the invention involves transport of ethanol for a distance more than 1 km, preferably over 5 km, and able to exceed 20 to 50 km. The flow rate is generally high and greater than 10 liters per second, preferably greater than 100 liters per second.

Generally, the polymer is used in a composition made of water and ethanol or a mix of both. The polymer that facilitates friction reduction during ethanol transport in a pipeline can be used in a concentrated solution or dispersion (in the range of 1,000 to 20,000 ppm). This solution may or may not be diluted beforehand, before combining it with ethanol. This is advantageously diluted in ethanol or a fluid with an ethanol base such as the one described above. The only concentration limit for this concentrated solution or dispersion corresponds to the manipulation limit owing to an increased viscosity with an increase in polymer concentration.

The polymer is generally introduced in a pipe transporting ethanol by any means known to a skilled person that makes it possible for a polymer or a solution/composition to combine with the fluid (ethanol), preferably in a pipeline carrying the fluid (ethanol). Among such means, the system of injecting a fluid into a pipeline seems the most appropriate.

The process for ethanol transport can also include the following steps:

- The preparation of a composition, made up of at least one polymer, capable of reducing friction, obtained from at least one monomer: N-alkylacrylamide or N,N-dialkylacrylamide,
- Combination of this composition with ethanol, preferably by introducing the composition into a pipe carrying the ethanol.

In a preferred embodiment, the composition includes water and/or ethanol.

The quantity of polymer used in the process according to the invention ranged between 5 and 5,000 ppm in weight relative to ethanol, preferably less than 1,000 ppm and even more preferably between 10 and 500 ppm in weight relative to ethanol.

The polymer can be introduced once or many times, throughout the transport.

The process according to the invention has some definite advantages with regard to ethanol transport (bioethanol, in particular). The polymers defined above efficiently reduce the friction during ethanol transport and thus facilitate the transport of large quantities over long distances. Hence the energy required for ethanol transport is significantly reduced.

The specific or preferred embodiments described in this invention can be combined with these, in order to get a preferred specific method unless clearly indicated that this combination is not wanted.

The invention and its advantages thereof will become evident clearly from the following illustrative embodiments that are not of a restrictive nature.

EXAMPLES

Example 1: DMA Homopolymer

An aqueous phase is prepared by combining 520 g of N,N-dimethylacrylamide (DMA) with 978.2 g permuted water. The pH is adjusted to 5 by adding 1.8 g acetic acid. Many additives are added to the aqueous phase: 0.04 g of a sodium diethylenetriaminepentaacetate solution at 40%, 0.01 g sodium hypophosphite and 1.5 g azo-bis-isobutyronitrile. Polymerisation is carried out in adiabatic conditions by adding an oxidation-reduction couple (typically sodium persulfate/iron salt II). The temperature rises to 70° C. in 4 hours. The finished product is a gel that is dried, ground and crushed to get the required product in powdered form.

Example 2: DMA/ATBSNa Copolymer 95/5 (mol %)

The protocol used for example 1 has been used again but the composition of the aqueous phase has been modified: 494 g of N,N-dimethylacrylamide (DMA), 120.25 g of the acrylamido-methyl-propyl-sulfonic acid (ATBSNa) sodium salt solution at 50%, 2.25 g acetic acid to attain a pH of 4 and 883.5 g permuted water.

Example 3: DMA/ADAMQUAT Copolymer 95/5 (mol %)

The protocol used for example 1 has been used again but the composition of the aqueous phase has been modified: 493.75 g N,N-dimethylacrylamide (DMA), 63.55 g of an acryloyl-ethyl-trimethylammonium chloride solution (ADAMQUAT) at 80%, 9.125 g acetic acid to attain a pH of 4.2 and 933.575 g permuted water.

Example 4: Assessment of Friction Reduction

The friction reduction in ethanol was assessed in the turbulent regime by using a flow loop system. A 3 meter tube with a diameter of ⅛ inches (⅛") is used. At 20° C. and a flow rate of 60 L/h, the Reynolds number applied is 12,000.

Monitoring the friction reducing effect is done by measuring the loss of load in the tube.

The tested polymers were dissolved in ethanol beforehand at 10,000 ppm (mother solution). This helps to verify whether all the prepared polymers exhibit good solubility in ethanol.

The results are given in table 1 below.

TABLE 1

Assessment of the friction reduction

| Nature of the polymer | Polymer concentration | Pressure | Reduction in pressure | Reduction in friction |
|---|---|---|---|---|
| None | / | 11.8 bar | / | / |
| N,N-DMA Homopolymer (example 1) | 100 ppm | 7.8 bar | 4 bar | 34% |
| N,N-DMA/ATBSNa Copolymer (95/5 mol %) (example 2) | 50 ppm | 8.4 bar | 3.4 bar | 29% |
| N,N-DMA/ATBSNa Copolymer (95/5 mol %) (example 2) | 100 ppm | 7.8 bar | 4 bar | 34% |
| ATBS Homopolymer (counter-example) | 100 ppm | 9.8 bar | 2 bar | 17% |
| ATBS/AcM Copolymer (60/40 mol %) (counter-example) | 100 ppm | 9 bar | 2.8 bar | 24% |

AcM = Methyl acrylate

The results of the experiments show that polymers according to the invention (examples 1 and 2) can effectively reduce friction during ethanol transport.

Even if the polymers comprising ATBS (counter-examples in table 1) are also able to reduce friction, its improvement is significantly lower as a result of the presence of polymers in this invention.

A new series of experiments were carried out by studying the stability of the polymer on the basis of time. By way of comparison, a PEG (polyethylene glycol) with a molecular weight of 900,000 being considered an efficient friction reducer for ethanol (BR200900355), was studied. The results are given in table 2 below.

TABLE 2

Assessment of the friction reduction on the basis of time

| Nature of the polymer | Polymer concentration | Pressure | Reduction in pressure | Reduction in friction |
|---|---|---|---|---|
| None | / | 13.3 bar | / | / |
| PEG (Mw = 900,000) | 100 ppm | 7.6 bar (after 10 sec) | 5.7 bar | 43% |
| | | 11.4 bar (after 5 min) | 1.9 bar | 14% |
| N,N-DMA/ | 100 ppm | 7.9 bar | 5.4 bar | 41% |

TABLE 2-continued

| Assessment of the friction reduction on the basis of time | | | | |
|---|---|---|---|---|
| Nature of the polymer | Polymer concentration | Pressure | Reduction in pressure | Reduction in friction |
| ADAMQUAT Copolymer (95/5 mol %) (example 3) | | (after 10 sec) 7 bar (after 5 min) 6.5 bar (after 10 min) | 6.3 bar 6.8 bar | 47% 51% |

It seems that the polymer according to the invention (example 3) remains stable on the basis of time and its friction reducing power is not affected even after 10 minutes. The PEG reference does not exhibit this kind of stability. After only 5 minutes, its effectiveness is reduced by a factor of 3.

The results of the experiments prove that the polymers according to the invention (examples 1 to 3) can effectively reduce friction during ethanol transport.

The invention claimed is:

1. A process for reducing friction during ethanol transport through pipelines, the process comprising combining ethanol with a polymer-based composition comprising a polymer obtained from at least 50 mol % of at least one non-ionic monomer selected from the group consisting of N-substituted acrylamides, N-substituted methacrylamides, N,N-substituted acrylamides, N,N-substituted methacrylamides, substituted acrylates and substituted methacrylates, wherein the quantity of polymer combined with ethanol ranges between 5 and 5,000 ppm in weight as regards the weight of ethanol.

2. The process according to claim 1, wherein the polymer has a molecular weight ranging between 0.5 and 25 million g/mol.

3. The process according to claim 1, wherein the at least one monomer has a substituted chain containing less than 30 carbon atoms.

4. The process according to claim 1, wherein the N-substituted acrylamide monomers, N-substituted methacrylamide monomers, N,N-substituted acrylamide monomers and N,N-substituted methacrylamide monomers are selected from the group consisting of N-ethylacrylamide, N-isopropylacrylamide, N-tert-Butylacrylamide, Diacetoneacrylamide, N-hydroxyethylacrylamide, N-hydroxymethylacrylamide, N-alkyl acrylamide, N-[Tris(hydroxymethyl)methyl] acrylamide, N-acryloylmorpholine, N,N-Dimethylacrylamide, N,N-diethylacrylamide and N,N-dialkylacrylamide; alkyl representing an alkyl group comprising 3 to 22 carbon atoms.

5. The process according to claim 1, wherein the substituted acrylate monomers and substituted methacrylate monomers are selected from the group consisting of methyl acrylate, ethyl acrylate, propyl acrylate, butyl acrylate, methyl methacrylate, ethyl methacrylate, propyl methacrylate, butyl methacrylate, other alkyl acrylate, alkyl methacrylate, isobornyl acrylate, isobornyl methacrylate, 2-ethylhexyl acrylate, 2-ethylhexyl methacrylate, Hydroxyethyl acrylate, Hydroxyethyl methacrylate, hydroxypropyl acrylate, hydroxypropyl methacrylate, furfuryl acrylate, furfuryl methacrylate, tetrahydrofurfuryl acrylate, tetrahydrofurfuryl methacrylate, glyceryl acrylate, glyceryl methacrylate, glycidyl acrylate, and glycidyle methacrylate; alkyl representing an alkyl group comprising 5 to 22 carbon atoms.

6. The process according to claim 1, wherein the polymer additionally includes 5 mol % to less than 40 mol % of at least one ionic monomer.

7. The process according to claim 6, wherein the ionic monomer is an anionic monomer selected from the group consisting of acrylic acid, methacrylic acid, itaconic acid, maleic acid, and 2-Acrylamido-2-methylpropane sulfonic acid (ATBS), the said anionic monomer being in its acid form, salified either partially or completely.

8. The process according to claim 1, wherein the polymer includes at least 80 mol % of the at least one monomer selected from the group consisting of N-substituted acrylamides, N-substituted methacrylamides, N,N-substituted acrylamides, N,N-substituted methacrylamides, substituted acrylates and substituted methacrylates.

9. The process according to claim 1, wherein the polymer is a polymer selected from the group consisting of N,N-dimethylacrylamide homopolymer, N,N-diethylacrylamide homopolymer, N,N-dimethylacrylamide copolymer and acrylic acid copolymer, N,N-diethylacrylamide copolymer and acrylic acid copolymer, N,N-dimethylacrylamide copolymer and 2-Acrylamido-2-methylpropane sulfonic acid copolymer and N,N-diethylacrylamide copolymer and 2-Acrylamido-2-methylpropane sulfonic acid copolymer.

10. The process according to claim 1, wherein the polymer is obtained by a gel synthesis process.

11. The process according to claim 1, wherein the composition additionally comprises water and/or ethanol.

12. The process according to claim 1, wherein the polymer is obtained from at least 50 mol % of at least one non-ionic monomer selected from the group consisting of N-substituted acrylamides, N-substituted methacrylamides, N,N-substituted acrylamides, and N,N-substituted methacrylamides.

13. The process according to claim 1, wherein the ethanol is bioethanol.

14. The process according to claim 2, wherein the at least one monomer has a substituted chain containing at least 30 carbon atoms.

15. The process according to claim 2, wherein the N-substituted acrylamide monomers, N-substituted methacrylamide monomers, N,N-substituted acrylamide monomers and N,N-substituted methacrylamide monomers are selected from the group consisting of N-ethylacrylamide, N-isopropylacrylamide, N-tert-Butylacrylamide, Diacetoneacrylamide, N-hydroxyethylacrylamide, N-hydroxymethylacrylamide, N-alkyl acrylamide, N-[Tris(hydroxymethyl)methyl] acrylamide, N-acryloylmorpholine, N,N-Dimethylacrylamide, N,N-diethylacrylamide and N,N-dialkylacrylamide; alkyl representing an alkyl group comprising 3 to 22 carbon atoms.

16. The process according to claim 2, wherein the substituted acrylate monomers and substituted methacrylate monomers are selected from the group consisting of methyl acrylate, ethyl acrylate, propyl acrylate, butyl acrylate, methyl methacrylate, ethyl methacrylate, propyl methacrylate, butyl methacrylate, other alkyl acrylate, alkyl methacrylate, isobornyl acrylate, isobornyl methacrylate, 2-ethylhexyl acrylate, 2-ethylhexyl methacrylate, Hydroxyethyl acrylate, Hydroxyethyl methacrylate, hydroxypropyl acrylate, hydroxypropyl methacrylate, furfuryl acrylate, furfuryl methacrylate, tetrahydrofurfuryl acrylate, tetrahydrofurfuryl methacrylate, glyceryl acrylate, glyceryl methacrylate, glycidyl acrylate, and glycidyle methacrylate; alkyl representing an alkyl group comprising 5 to 22 carbon atoms.

17. The process according to claim 2, wherein the polymer additionally includes at least 40 mol % of at least one ionic monomer.

18. The process according to claim 17, wherein the ionic monomer is an anionic monomer selected from the group consisting of acrylic acid, methacrylic acid, itaconic acid, maleic acid, and 2-Acrylamido-2-methylpropane sulfonic acid (ATBS), the said anionic monomer being in its acid form, salified either partially or completely.

19. The process according to claim 18, wherein the polymer includes at least 80 mol % of the at least one monomer selected from the group consisting of N-substituted acrylamides, N-substituted methacrylamides, N,N-substituted acrylamides, N,N-substituted methacrylamides, substituted acrylates and substituted methacrylates.

20. The process according to claim 19, wherein the polymer is a polymer selected from the group consisting of N,N-dimethylacrylamide homopolymer, N,N-diethylacrylamide homopolymer, N,N-dimethylacrylamide copolymer and acrylic acid copolymer, N,N-diethylacrylamide copolymer and acrylic acid copolymer, N,N-dimethylacrylamide copolymer and 2-Acrylamido-2-methylpropane sulfonic acid copolymer and N,N-diethylacrylamide copolymer and 2-Acrylamido-2-methylpropane sulfonic acid copolymer.

* * * * *